US006033096A

United States Patent [19]

Liu

[11] Patent Number: 6,033,096

[45] Date of Patent: Mar. 7, 2000

[54] DECORATIVE LIGHT SYSTEM

[76] Inventor: Chun Ming Liu, No. 30, Kwo-Fong Road, Hsinchu, Taiwan

[21] Appl. No.: 09/243,429

[22] Filed: Feb. 3, 1999

[51] Int. Cl.[7] ..... F21V 21/00

[52] U.S. Cl. ..... 362/396; 362/806

[58] Field of Search ..... 362/123, 226, 362/249, 252, 396, 806, 382

[56] References Cited

U.S. PATENT DOCUMENTS 5,632,552 5/1997 Wang et al. ..... 362/396

5,779,352 7/1998 Lin ..... 362/249

*Primary Examiner*—Y. Quach

*Attorney, Agent, or Firm*—Rosenberg, Klein & Lee

[57] ABSTRACT

The object of the present invention discloses an improved decorative light system comprising an assembly of a socket including a pair of sliding jaw with a pair of bevel hook on the tip thereof, a supporting rod, and an inserting plate with an inserting hole, wherein the supporting rod inserts into the gap between the sliding jaws and plug the combination into the hole by pressing the bevel hooks and sliding thereto.

1 Claim, 4 Drawing Sheets

DECORATIVE LIGHT SYSTEM

BACKGROUND OF THE INVENTION

The decorative lights are usually hanged directly on a Christmas tree, or fixed each light bulb in a supporter with a designed pattern to express a particular impression. Referring to FIG. 1, one conventional fix-typed decorative light system comprises a supporter (1) having a hole (11) and a pair of extrusion (21) extended from a clamp (2). When setting up the light system, the clamp (2) is allowed to clip the socket (3) first, and then the extrusion (21) is inserted into said hole (11). Though the decorative light system can arrange each light bulb on a specific position, the way of clipping the clamps and sockets is inconvenience and labor-wasting. Furthermore, other drawbacks include that it is easily get loose between the clamp and socket, and the wide supporter will obscure the illumination from the light bulbs.

SUMMARY OF THE INVENTION

The object of the present invention discloses an improved decorative light system comprising an assembly of a socket (3) including a pair of sliding jaw (31) with a pair of bevel hook (32) on the tip thereof, a supporting rod (5), and an inserting plate (4) with an inserting hole (41), wherein the supporting rod (5) inserts into the gap between the sliding jaws (31) and plug the combination into the hole (41) by pressing the bevel hooks (32) and sliding thereto.

DETAILED DESCRIPTION OF THE PREFERRED EMBODIMENT OF THE INVENTION

Figure 1:
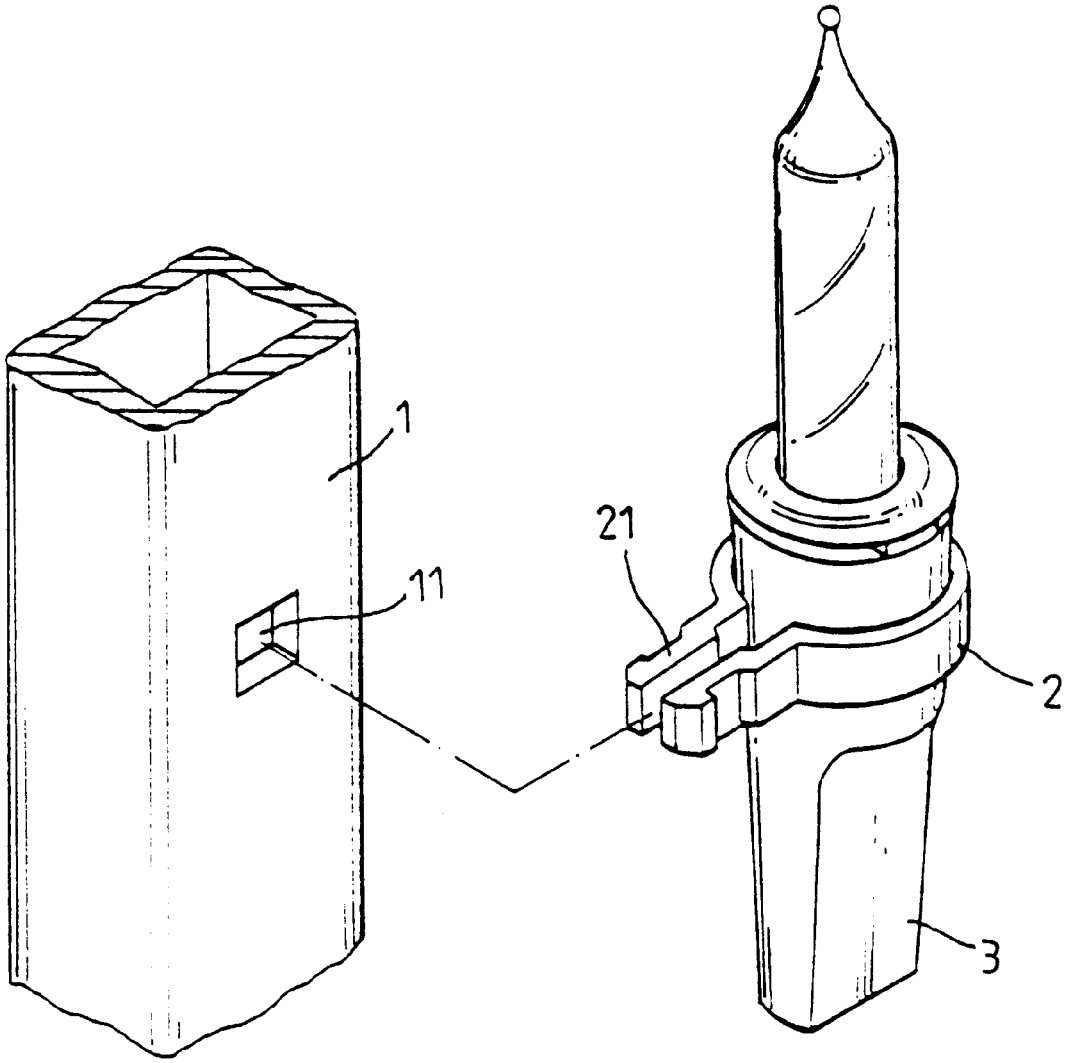
FIG. 1 (prior art)
FIG. 1 is an elevation front view of the conventional fix-typed decorative light system.
Figure 2:
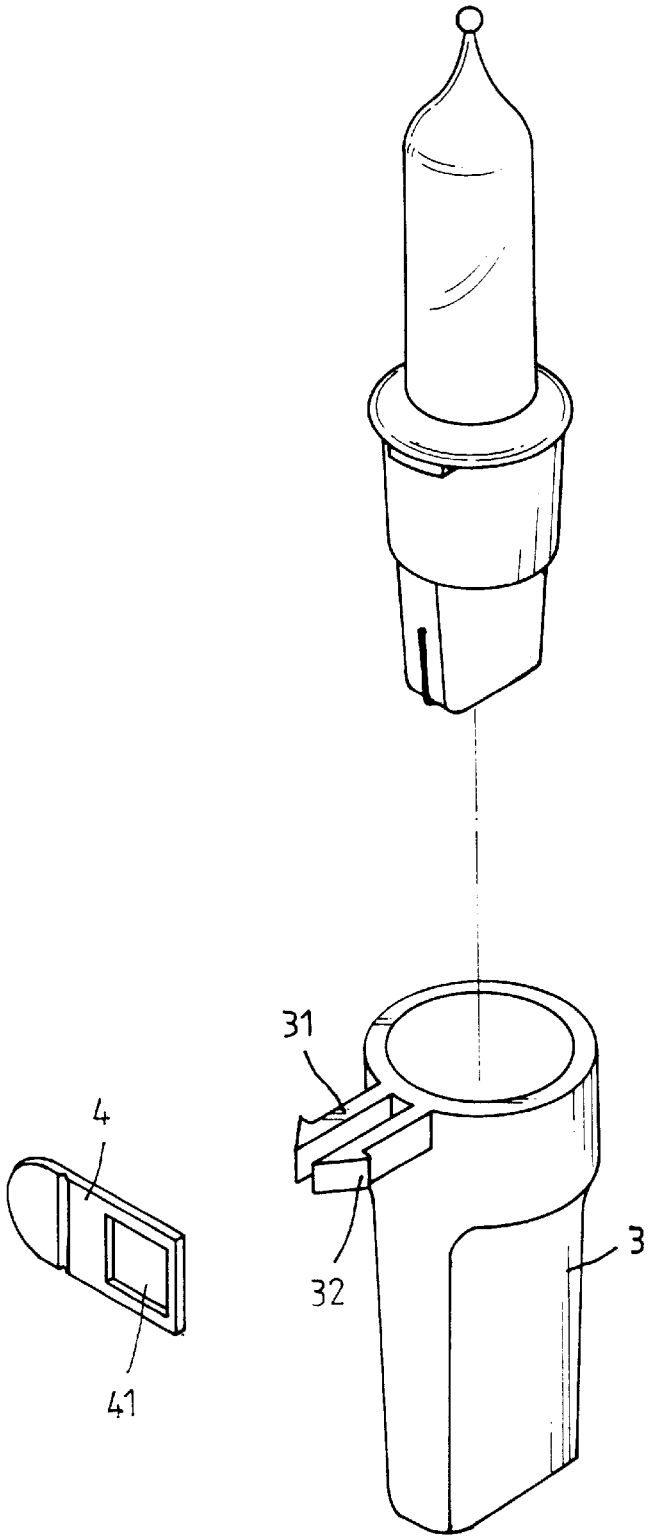
FIG. 2 is an elevation front view of the present invention wherein each means is separated.

FIG. 2 illustrates each means separately, wherein on the top rim of the socket (3) there is a pair of sliding jaw (31) with a pair of bevel hook (32) on the tip, and a gap exists between the sliding jaws (31) to bestow a supporting rod (5). The socket (3) is connected with the supporting rod (5) between the sliding jaws (31), and the sliding jaws (31) are passed into an inserting hole (41) on an additional inserting plate (4), the bevel hook (32) can be pressed easily and slide into the inserting hole (41) to firmly clamp said supporting rod (5) on the gap between the sliding jaws (31).

Figure 3:
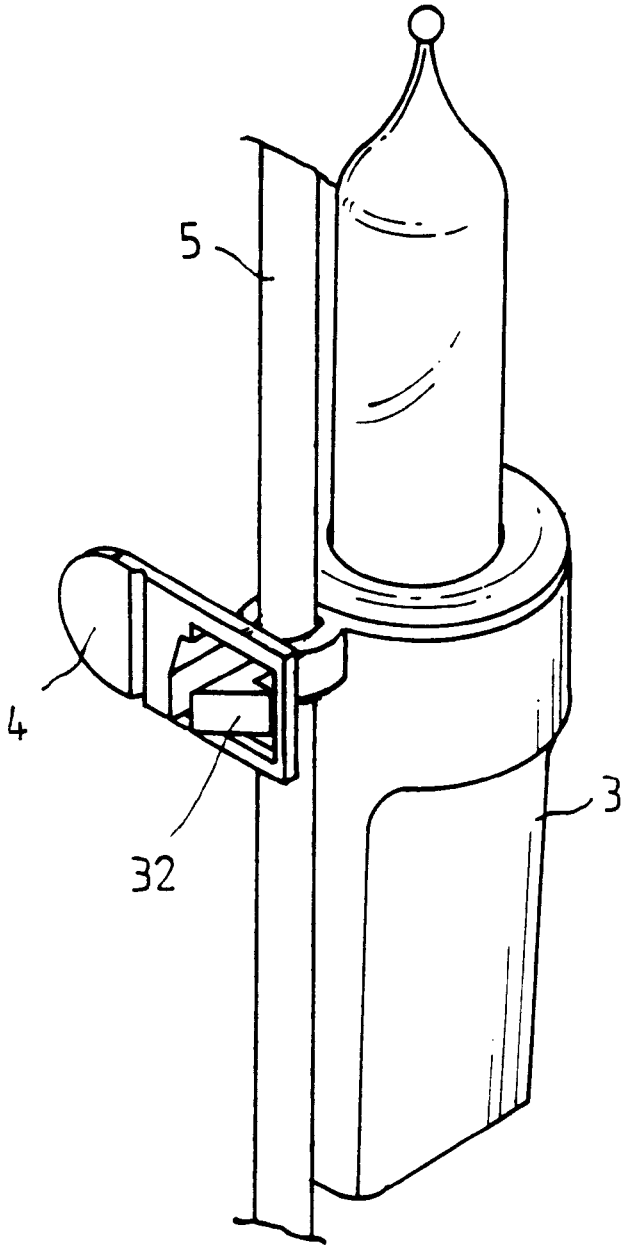
FIG. 3 is an elevation front view of the present invention wherein said system is combined.
Figure 4:
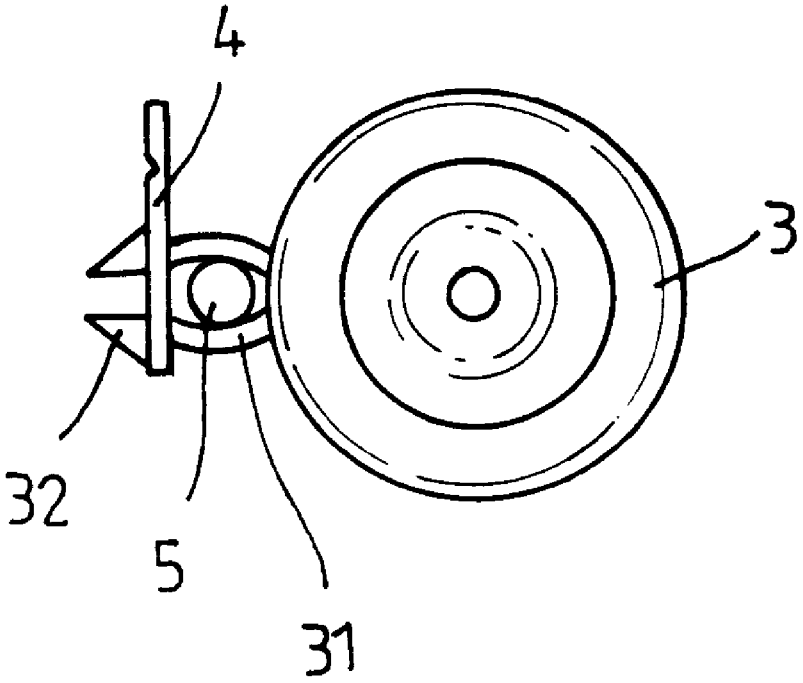
FIG. 4 is a top view of the present invention.

Referring to FIGS. 3 and 4, the combined decorative light system indicates that the supporting rod (5) is clamped tightly by the sliding jaws (31) and the inserting plate (4) to form a stable combination.

Accordingly, the present decorative light system provides an economic method to combine the socket, supporting rod and inserting plate when compared with the conventional light system. Furthermore, the way of arranging the light bulbs and the illumination of the light are improved because the supporting rod thereof is much thinner than the conventional supporter.

Although the present invention has been explained in relation to its preferred embodiment, it is to be understood that many other possible modifications and variations can be made without departing from the spirit and scope of the invention hereinafter claimed.

I claim:

1. An improved decorative light system comprising:

a socket assembly including a pair of sliding jaws having a gap formed therebetween, each of said sliding jaws having a bevel hook formed on a tip thereof;

a supporting rod extending through said gap; and, an inserting plate having an inserting hole formed therethrough, wherein said sliding jaws with said supporting rod therebetween are inserted into said inserting hole with said bevel hooks providing engagement with said inserting plate.

* * * * *